United States Patent [19]

Kamogawa et al.

[11] 4,021,709

[45] May 3, 1977

[54] METHOD AND DEVICE FOR CHARGING AN ELECTROPHOTOGRAPHIC PHOTOSENSITIVE MATERIAL

[75] Inventors: Nin-ichi Kamogawa; Tohru Uchida, both of Hachioji, Japan

[73] Assignee: Konishiroku Photo Industry Co., Ltd., Tokyo, Japan

[22] Filed: Sept. 19, 1975

[21] Appl. No.: 614,932

[30] Foreign Application Priority Data

Sept. 20, 1974 Japan ..... 49-109193

[52] U.S. Cl. ..... 361/229; 250/326

[51] Int. Cl.[2] ..... G03G 15/02

[58] Field of Search ..... 317/262 A; 250/324, 250/325, 326; 96/1 C

[56] References Cited

UNITED STATES PATENTS 3,777,158 12/1973 Kamogawa et al. ..... 317/262 A X

*Primary Examiner*—Harry Moose

*Attorney, Agent, or Firm*—Bierman & Bierman

[57] ABSTRACT

Method and apparatus for enhancing charge retention of a photosensitive layer wherein an ion wind is created and applied to the photosensitive material prior to its reuse. The apparatus preferably comprises a corona charging unit having an opening and directing means adjacent the opening for directing the flow of ions created during corona charging into an uncharged portion of the photosensitive layer.

6 Claims, 12 Drawing Figures

METHOD AND DEVICE FOR CHARGING AN ELECTROPHOTOGRAPHIC PHOTOSENSITIVE MATERIAL

This invention relates to a method and a device for electrophotographic photosensitive material for use in electrophotography and more particularly to such a method and a device for use in charging a photosensitive material of zinc-oxide type.

In an electrophotographic copying machine wherein the photosensitive material such as zinc-oxide is repeatedly used, there is a tendency that chargeability of the material becomes lower and lower due to degradation thereof with the result that density of the resulting reproduced image is lowered and thus the quality of the image becomes poor.

The method of obtaining a reproduced image on ordinary paper by a Carlson process utilizing the photosensitive material repeatedly is composed of the following steps:

At first, the photosensitive material is uniformly charged by corona discharging; the electric charge thus supplied is selectively removed by light exposure of an image to be reproduced to form an electrostatic latent image; the latent image is made visual with use of a toner at a developing station and the visual toner image is transferred onto an ordinary paper to make a copy. On the other hand, the photosensitive material is subjected to a cleaning process for its reuse, in which process residual electrostatic charge is removed by light exposure and then a residual toner is removed by a cleaning device such as a fur brush, and then the photosensitive material is again brought into charging process.

Such repetitive use of the photosensitive material causes various practical difficulties and many researches and improvements have been made to overcome them. One of the various problems in the art is degradation of chargeability of the photosensitive material at uniform recharging stage subsequent to the cleaning stage. This phenomenon is that even if charges are applied on the photosensitive material by corona discharge at constant level, potentials on the surface of the photosensitve materials become lower, and is called "Memory Effect." This effect is conspicuous particularly in the zinc-oxide photosensitive material. Inventors have found that an ion wind (or it is called a corona wind) emanated from the charging device has an outstanding effect on recovery of the memory effect, that is recovery of the chargeability.

Figure 1:
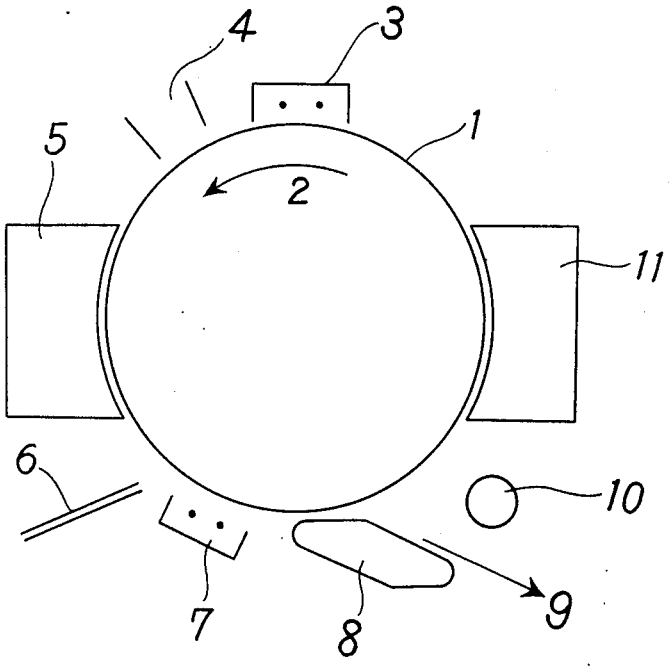
Figure 2:
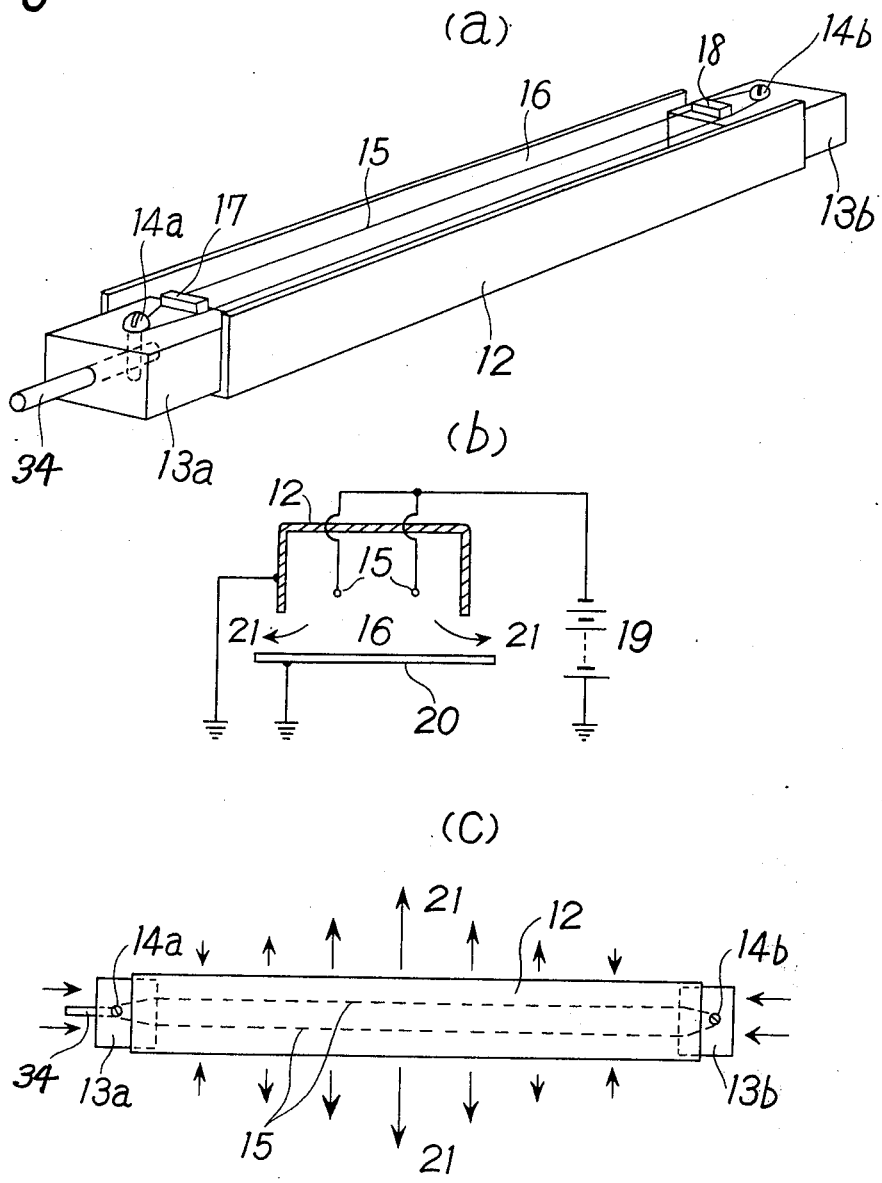
Figure 3:
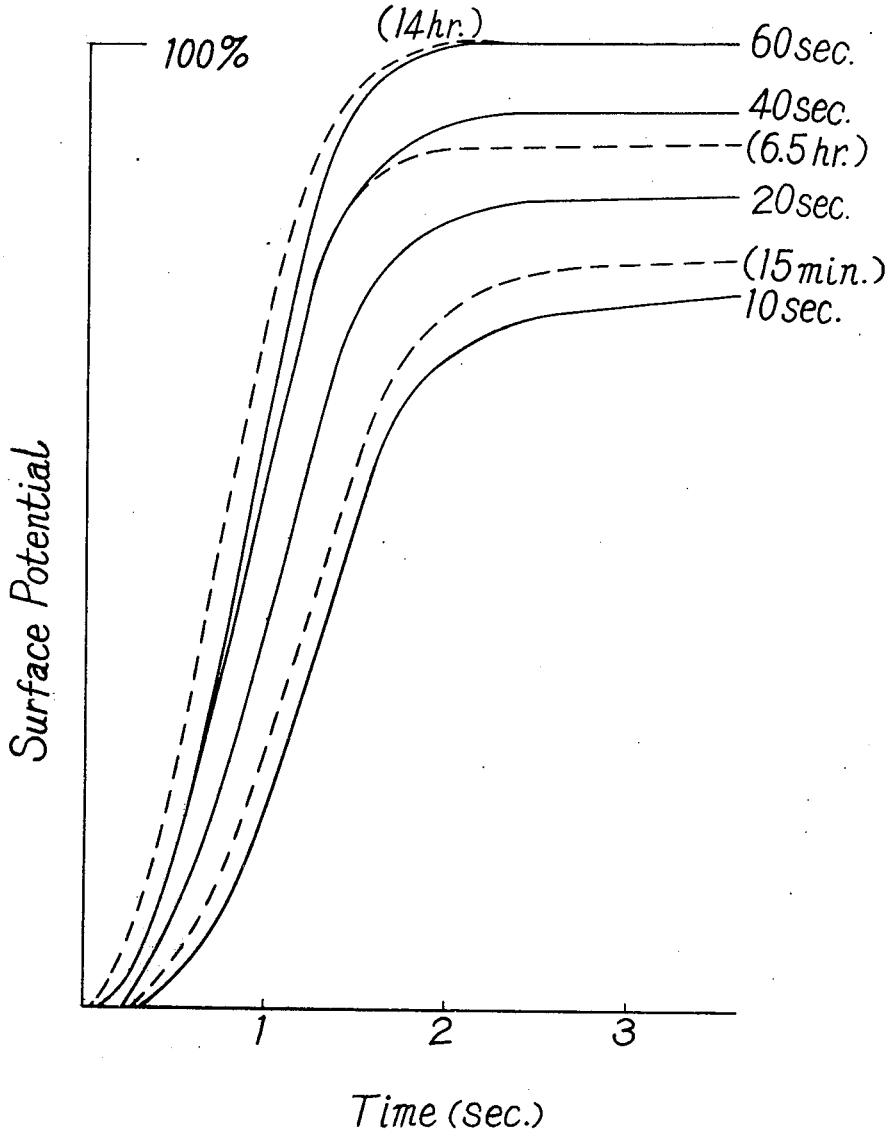
Figure 4:
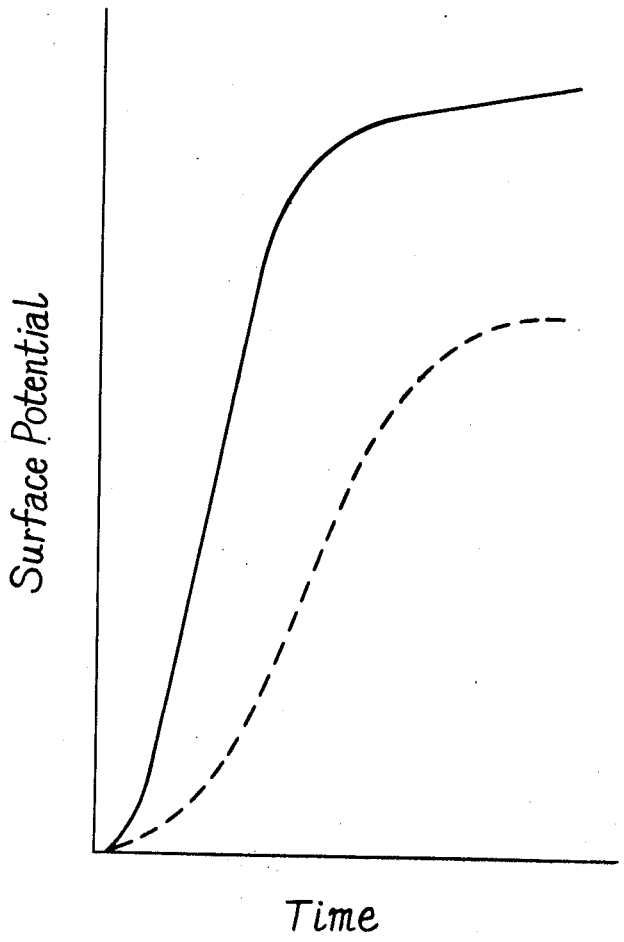
Figure 5:
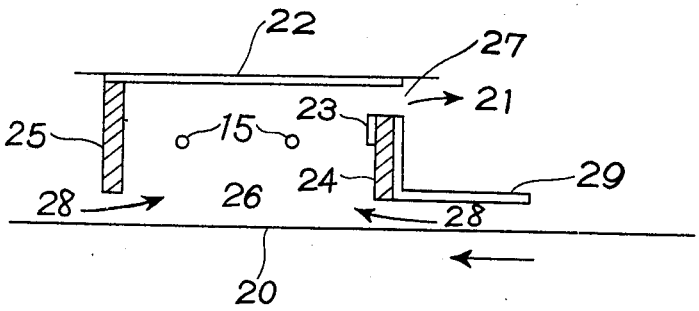
Figure 6:
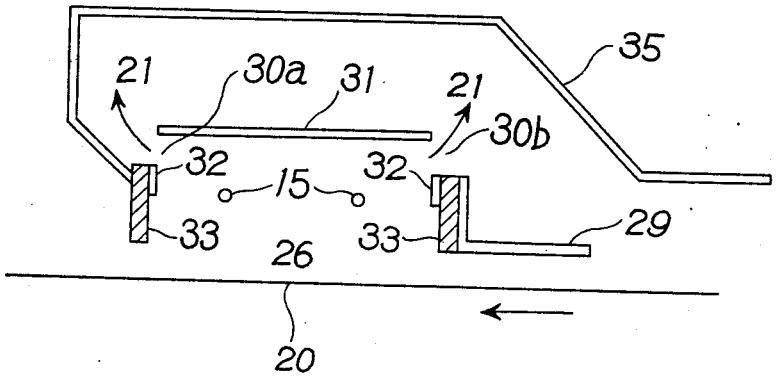
Figure 7:
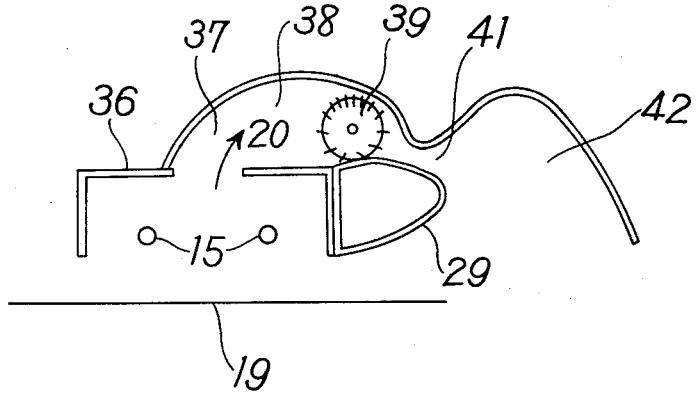
Figure 8:
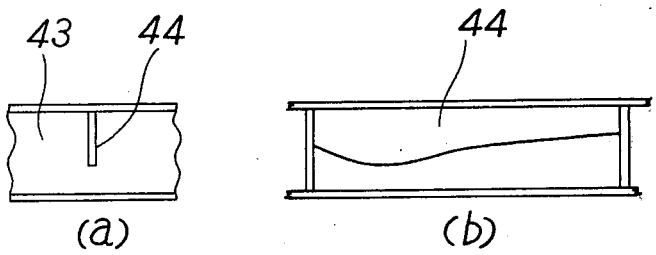
Figure 9:
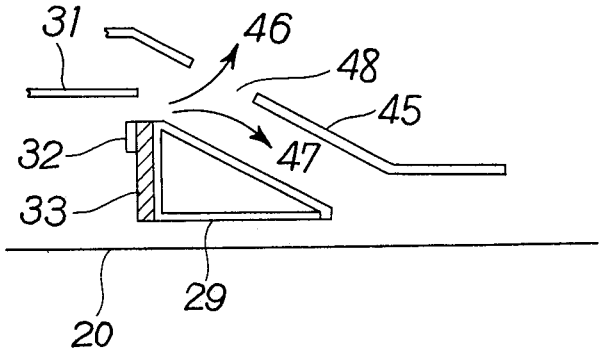

The invention will now be described in more detail by reference to the accompanying drawings in which;

FIG. 1 is a schematic illustration of an electrophotographic reproduction system including processes of charging, light-exposure, developing, transferring and cleaning, FIG. 2(*a*) is a perspective view of a conventional electric charging device positioned upside down, FIG. 2(*b*) is a side vew of the charging device in section with a high voltage supply source and a photosensitive material combined in operative relationship therewith, and FIG. 2(*c*) is a plan view of the charging device of FIG. 2(*a*), FIG. 3 is a comparative illustration of recovery of the memory of the photosensitive material kept in the dark (shown in an broken line) and with the aid of the ion wind (shown in a solid line), FIG. 4 is an illustration of quickness of raise of electric charging with respect to time with much and less ion wind applied after pre-exposure under the condition similar to a real reproducing machine, FIGS. 5, 6 and 7 show different embodiments of the corona discharging devices according to the present invention, FIG. 8(*a*) shows a part of the passage for the ion wind equipped with a correction member therein and FIG. 8(*b*) is a front view of the correction member of FIG. 8(*a*) and FIG. 9 shows an arrangement of the intensity adjusting means of the ion wind suitably employed in the present invention.

Referring now to the drawings, FIG. 1 illustrates schematically a conventional electrophotographic reproduction system and explanation will be given to the processes of the electrophotography. A drum 1 with a photosensitive material or layer on its peripheral surface rotates in the direction indicated by an arrow 2. Reference numeral 3 designates a corona discharging device used as an electric charging and numeral 4 is a light exposure slit, 5 is a developing device, 6 a transfer sheet supplier, 7 a corona discharging device for image transfer and 8 is a separator for separating the transfer sheet electrostatically attracted onto the photosensitive material. The transfer sheet is taken out in the direction indicated by an arrow 9. Reference numeral 10 is a cleaning lamp and 11 is a cleaning device. The photosensitive material or the drum 1 continues to rotate and passes again the corona discharging device 3 and the following processes in sequence.

The ion wind is an electrically neutral wind exhaled from the corona discharging device upon corona discharge and will be described with reference to FIGS. 2(*a*), 2(*b*) and 2(*c*). An ordinary charging device which is used in the field of electrophotography is shown in FIG. 2(*a*), and comprises an electrically conductive shield trough 12, insulating blocks 13*a* and 13*b* respectively located at the ends of the shield trough 12 and a pair of discharging wires 15 used as a discharging electrode which is secured at its both ends to the insulating blocks 13*a* and 13*b* by screws 14*a* and 14*b*. Shield trough 12 has an opening 16 at its one side. Two wires 15 are spaced parallel by bars 17 and 18, and are connected together with a high voltage source 19 through the screw 14*a* and a plug 34 as shown in FIG. 2(*b*). The shield trough 12 is grounded and is so positioned that the opening 16 faces the photosensitive material 20. Upon corona discharging, it is observed that an ion wind is produced and exhaled out of the space between side walls of the shield trough 12 and the photosensitive material 20 in the direction indicated by an arrow 21. FIG. 2(*c*) is a top view of the shield trough 12. The ion wind will exhale out of the shield trough 12 as shown by reference numeral 21 but does not distribute uniformly along the longitudinal direction of the shield trough 12. The ion wind exhales more at the central portion of the shield trough 12 and is inhaled thereinto at the portions nearer the ends of the shield trough 12.

Since the wind occurs due to the charged particles being drifted with electric field and moving towards the photosensitive material 20 which collide against electrically neutral gas particles and share its momentum, the charged particles will flow generally along the electric field and when the charged particles arrive at the photosensitive material, they deposite thereon while the ion wind flows along the photosensitive surface as shown by an arrow 21 as is the case with an ordinary wind striking a wall. Exhalation of the ion wind causes decrease in pressure inside the corona discharging device, so that the air flows into the device from the sides of the insulating blocks 13*a* and 13*b* at the positions of which there is no corona current and the air also flows into the discharging device at its end portions against the direction of the electric field. Thus, the characteristic distribution of the ion wind is produced as shown in FIG. 2(*c*). In FIG. 2(*c*), the length of arrows is representative of the amount of the ion wind which is exhaled out of and inhaled into the device.

As seen from the explanation above given, the ion wind consists of no charged particle and this fact was confirmed by experiment. It is noted that if the zinc-oxide photosensitive material is exposed to this ion wind after being subjected to pre-exposure, prominent recovery effect of memory as shown in FIGS. 3 and 4 is recognized. FIG. 3 is a comparative illustration of the memory recovery effect for the zinc-oxide photosensitive material kept in the dark which material has been subjected to irradiation of illumination of 1000 lx. for 3 minutes (with a broken line) and the memory recovery effect for the same material in the ion wind (with a solid line). The period of time indicated in FIG. 3 is the time for the photosensitive material to have been kept in the dark and the time for the material to have been exposed to the ion wind.

As seen from FIG. 3, the surface potential recovers 100% both for the photosensitive material kept in the dark for 14 hours and the material subjected to the ion wind for 60 seconds.

It is therefore seen that the memory of the photosensitive material can be recovered in a short time by applying the ion wind to the material.

FIG. 4 shows quickness of raise of electric charging with respect to time with much and less ion wind after pre-exposure under the condition similar to a real reproducing machine (It has been confirmed, however, that no change was made in corona current.). A solid line shows the case with more ion wind and a broken line shows the case with less ion wind.

While there are no charged particles in the ion wind exhaled out of the charging device, a large quantity of active particles produced by corona discharging exist therein as compared with the air. Namely, the ion wind consists of mixture of oxygen atom O, ozone and other gaseous particles. Therefore, the outstanding recovery function of the memory by means of the ion wind can be interpreted as follows:

When the zinc-oxide photosensitive material is subjected to light irradiation, electron-hole pairs are produced and the holes capture the electrons which are trapped by oxygen on the surface of microcrystallines of zinc oxide. As a result of this action, the oxygen causes photodesorption. Accordingly, even if irradiation is ceased and the zinc-oxide photosensitive material is again put in the dark, there exist a number of free electrons in the zinc-oxide photosensitive layer until recombination of the oxygen is fully advanced thus causing memory effects. Application of the ion wind under such condition causes the active particles in the ion wind to quickly capture the free electrons in the photosensitive layer owing to large capture cross section of the electrons so that recovery of the memory is accelerated.

It has thus been seen that the ion wind is effective for recovery of the memory, however, the ion wind distributes unevenly in an ordinary charging device as shown in FIG. 2(*c*) and this is quite undesirable. For the purpose of recovery of the memory, the ion wind should preferably be applied to the photosensitive material before being electrically charged and it is rather harmful to apply the wind to the body which has been electrically charged. This is because active particles such as ozone are effective to recover the memory but they should not be used except where required as sensitizing pigments and the like are broken. This is also because of the findings that application of the ion wind to the zinc-oxide photosensitive material at the time of exposure dulls its sensitivity. Namely, the ion wind exhaled at the side of the exposure slit from the charging device is quite objectionable to the zinc-oxide photosensitive material.

The embodiments of the charging device according to the present invention which are ideal for the zinc-oxide photosensitive material will now be described in the concrete with reference to FIGS. 5, 6 and 7 all showing the corona discharging device in section taken at the central portion thereof similar to FIG. 2(*b*) and in which the cleaning device is positioned at right hand side and the exposure slit is positioned at left hand side. This means that the photosensitive material moves from the right hand side through the corona discharging device to the left hand side.

In FIG. 5, the corona discharging wires 15 are surrounded at three sides by the grounded conductive back plate 22 and insulating side plates 24 and 25 and the remaining one side opens as the first opening 26 for electrical charging. An electrically conductive side plate 23 which is grounded is located on the inner side of the side plate 24 and there is provided an exhaust opening 27 between the side plate 23 and the back plate 22. The photosensitive material 20 faces the opening 26 of the charging device and the distance between the wires 15 and the photosensitive material 20 is selected to be larger than that between the wires 15 and the back plate 22. When high voltage is applied to the wires 15, more corona current will flow from the wires 15 to the back plate 22 and the conductive side plate 23 than from the wires 15 to the photosensitive material 20 and thus a large amount of ion wind 21 exhales from the exhaust opening 27. On the contrary, the air flows into the discharging device through the first opening 26 as shown by an arrow 28. The ion wind exhaled at the side of the cleaning device as shown by an arrow 21 scatters and strikes against the zinc-oxide photosensitive material 20, thereby accelerating recovery of the memory. Since no wind flows into through the exhaust opening 27 and, in other words, the opening 27 is only for exhaust of the ion wind, the ion wind exhaled along the length of the corona discharging wires does not distribute unevenly as shown in FIG. 2(*c*) and considerably uniform distribution can be obtained. A board 29 is an anti-detour board destined for preventing the chance for the ion wind to contact with the photosensitive material from decreasing as a result of the ion wind flowing into through the first opening 26. This board 29 also acts to provide clearance between itself and the photosensitive material 20 to facilitate contact of the active particles in the ion wind with the photosensitive material when a part of the ion wind 21 as exhaled flows into the charging device along the arrow 28. It is to be noted that one of the three walls surrounding the corona discharging wires is a conductive plate and the remaining two walls are insulating plates (on a part of one of the insulating plates is located a conducting side plate.) and that the distance between the wires 15 and the back plate 22 is made shorter than that between the wires 15 and the photosensitive material 20. However, it is to be understood that such an arrangement is only one example for realizing that more corona current is directed to the exhaust opening 27 rather than to the first opening 26 and thus the ion wind is allowed to flow out of the exhaust opening 27 but not to flow out of the first opening 26. Alternative arrangement is such that the distance between the wires 15 and the back plate 22 is made larger than that between the wires 15 and the photosensitive material 20 and that the back plate 22 is not grounded but supplied with the voltage of the polarity opposite to the voltage applied to the corona discharging wires 15 in the above-mentioned embodiment, so that the electric field established between the wires 15 and the back plate 22 is intensified to increase corona current thereby allowing the ion wind to exhale from the exhaust opening 27. Another arrangement may be such that the insulating plate 24 is replaced by an electrically conductive plate and application of the voltage of the same polarity as the discharging wires 15 decreases the electric field between the wires 15 and the plate as is electrically the same as the insulating plate, so that corona current decreases and the ion wind will exhale from the exhaust opening 27 owing to predominancy of the relative intensity of the electric field in the vicinity of the exhaust opening. In this way, the walls of the discharging device may be made of different materials and relative distance therebetween may be determined so that electrically identical function is provided. A back plate may be electrically biased to allow more corona current to flow to the exhaust opening than to the first opening. In brief, it is important to note that a corona current is allowed to flow more towards the, exhaust opening 27 rather than towards the photosensitive material 20 and thus the ion wind is allowed to exhale from the exhaust opening 27 and to flow into the device through the first opening. It is therefore to be understood that any change or modification in configuration, materials and relative disposition of the components may be made along the line of the above description by those skilled in the art.

The embodiment shown in FIG. 6 has exhaust openings 30*a* and 30*b* on the respective sides of the charging device. The device includes a pair of discharging wires 15, 15 which is surrounded by a grounded conductive back plate 31, and insulating side plates 33 on each of which a grounded conductive side plate 32 is attached. The wires 15, 15 are so positioned that the electric field is intensified in the vicinity of the exhaust openings 30*a* and 30*b* and the ion wind is allowed to flow into the first opening 26 and to exhale out of the exhaust openings 30*a* and 30*b*.

In the present embodiment, the distance between the wires 15 and the back plate 31 is 7.8 mm, the distance between the wires 15 and the photosensitive material 20 is 10 mm, the distance between wires is 12 mm and the lower end of both side plates 32 is horizontally coplanar with the wires 15, 15 and the distance between the wires 15 and the side plate is 8 mm. The ion wind exhaled from the exhaust opening 30*a* as shown by an arrow 21 is guided along the anti-scattering board 35 which is positioned near the photosensitive material 20 at the side of the cleaning device. As a result, the ion wind can effectively be used.

FIG. 7 shows further embodiment of the corona discharging device which does not rely on the electric field effect, but on fan drive. An exhaust opening 37 is provided on the upper portion of the conductive shield trough 36 surrounding the discharging wires 15 and a fan 39 is located in the passage 38 so as to draw the ion wind in the direction indicated by an arrow 20. The passage 38 is made narrower as at 41 and expanded immediately downstream to provide a large space as at 42. Such a configuration of the passage is effective to make uneven flow of the ion wind uniform. An anti-detour board 29 need not be positioned in the vicinity of the photosensitive material 19 if recovery of the memory is satisfactory.

FIG. 8 illustrates a part of the passage for the ion wind. In case uniformity of intensity of the ion wind exhaled from the exhaust opening is insufficient along the longitudinal direction of the charging device, a baffle plate 44 is positioned halfway of the passage 43 or in the vicinity of the outlet thereof as shown in FIG. 8(*a*) and has preferably the configuration as shown in FIG. 8(*b*) to provide correction for uniform intensity of the ion wind.

FIG. 9 illustrates an adjusting means for too intensive ion wind in the embodiment of the invention. A part of the ion wind is allowed to escape through the opening 48 formed on the anti-scattering board 45 as shown by an arrow 46 and the remaining ion wind is allowed to strike against the photosensitive material 20. In this way, intensity of the ion wind can be adjusted at will. However, in case the intensity is a little uneven along the longitudinal direction of the charging device, the configuration of the opening 48 of the slit for allowing the ion wind to escape upwards is made uneven and the opening is made different in width at different places. As a result of unevenness of the escaping ion wind as shown by the arrow 46, it is possible to make more uniform distribution of the ion wind 47 striking on the photosensitive material.

As has been described above, the corona discharging device or the charging device according to the present invention provides uniformity of the ion wind along the longitudinal direction of the charging device as a result of the ion wind being allowed to flow into the device through the first opening and to exhale from the exhaust opening, and pictures of good quality are presented by improving recovery of the memory by application of the ion wind to the photosensitive material near the cleaning station.

What we claim is:

1. A device for charging an electrophotographic photosensitive material comprising corona discharging electrodes, a shield member confining said discharging electrodes and having a first and at least one second openings, said photosensitive material being electrically charged through said first opening by corona current from said electrodes, and means to control the flow direction of an ion wind so as to exhaust the ion wind through said second opening and to apply the thus exhausted ion wind to a non-charged portion of the photosensitive material.

2. A device as set forth in claim 1 further comprising means to control distribution of the ion wind along a direction parallel to said corona discharging electrodes.

3. A device as set forth in claim 1 further comprising means to turn aside a part of the ion wind to be applied to said photosensitive material.

4. In a method for repeatedly producing an electostatic latent image on a zinc oxide type electrophotosensitive material comprising the steps of electrically charging the material by a corona discharge device, exposing the charged material to imagewise irradiation and photoelectrically removing the residual charge from said material, the improvement comprising the step of contacting said material with an ion wind from the discharge device prior to but not after completion of charging.

5. The method as set forth in claim 4 wherein the ion wind is exhaled at a selected distance from the corona discharge device, and preventing the ion wind from flowing toward the discharge device.

6. A method as set forth in claim 4 wherein the density of the ion wind from the corona discharge device is selectively controlled prior to being applied to said electrophotosensitive material.

* * * * *